United States Patent [19]

Wells

[11] 4,425,827

[45] Jan. 17, 1984

[54] SUSPENSION OF PIPE SPINNER

[75] Inventor: Lawrence E. Wells, Anaheim, Calif.

[73] Assignee: Varco International, Inc., Orange, Calif.

[21] Appl. No.: 351,462

[22] Filed: Feb. 23, 1982

[51] Int. Cl.[3] ..... B25B 13/50

[52] U.S. Cl. ..... 81/57.19; 81/57.2; 81/57.24; 81/57.35; 81/57.4

[58] Field of Search ..... 81/57.35, 57.24, 57.33, 81/57.4, 57.2, 57.19, 57

[56] References Cited

U.S. PATENT DOCUMENTS

| | | | |
|---|---|---|---|
| 2,556,536 | 6/1951 | Harris | 81/57.24 |
| 2,703,221 | 3/1955 | Gardner | 81/57.2 |
| 2,741,460 | 4/1956 | Gardner | 81/57.19 |
| 3,086,413 | 4/1963 | Mason | 81/57.19 |
| 3,921,473 | 11/1975 | Boyadjieff et al. | 81/57.19 |

*Primary Examiner*—James L. Jones, Jr.
*Attorney, Agent, or Firm*—William P. Green

[57] ABSTRACT

A pipe spinner is provided which includes two parts carrying rollers and mounted by two pivotal connections for swinging movement between a closed position in which the rollers grip and drive a well pipe or the like and an open position releasing the pipe, with an adjustable connection attaching the two pivotal connections together for relative lateral movement to shift the two pivotal axes toward and away from one another for gripping different sizes of pipe, and with the spinner including a hanger or support structure attached to the mentioned adjustable connection and adapted to be suspended by a line or other element in a manner suspending the entire tool through the adjustable connection.

19 Claims, 8 Drawing Figures

SUSPENSION OF PIPE SPINNER

BACKGROUND OF THE INVENTION

This invention relates to improved pipe spinners for turning one section of well pipe rapidly relative to another in order to spin the sections into or out of threaded engagement.

The spinners of the present invention are of a known general type including a series of rollers adapted to engage a well pipe at different locations about its periphery in a relation gripping the pipe between the rollers and then driving it rotatively by powered rotation of one or more of the rollers. Copending application Ser. No. 06/257,105 filed Apr. 24, 1981 by Boyadjieff et al. on "Pipe Spinning Tool" shows such a spinner in which two body parts carry rollers at opposite sides of a pipe and are mounted by two pivotal connections for swinging movement about two different axes to move the rollers toward and away from one another and between a closed position of gripping engagement with a pipe and an open position releasing the pipe from engagement with the rollers. In that prior arrangement, the two pivotal connections are desirably attached together by an adjustable connection capable of shifting the two pivotal connections and their axes toward and away from one another and thereby adjusting the spinner for optimum driving engagement with pipes of different sizes. The adjustable connection for varying the spacing between the two pivotal axes preferably includes interengaging threaded parts designed to shift the two axes relative to one another upon rotation of one of the threaded parts. More particularly, the adjustable connection may include two nuts attached to the two pivotal connections respectively and having right-hand and left-hand threads respectively engaging corresponding right-hand and left-hand threads of a third element which acts upon rotation to move the two nuts relatively toward or away from one another.

SUMMARY OF THE INVENTION

The present invention provides an improved arrangement for suspending a pipe spinner of the above discussed general type from a suspending line or the like in a manner effectively balancing the weight of the spinner in the various different adjusted positions of the pipe gripping parts, and doing so with an extremely simple structural arrangement designed to avoid complexities which might detract from the effective operation and long-term reliability of the tool on a rig.

To achieve these results, a spinner embodying the invention is suspended from the discussed adjustable connection which joins the two pivotal connections for their relative shifting movement. Preferably, a hanger or support structure is connected to and supports one of the previously mentioned relatively adjustable threaded members, desirably the member having both right-hand and left-hand threads. The hanger structure may include a part disposed about such a member having right-hand and left-hand threads and located between two nut elements engaging and actuated by those right-hand and left-hand threads. An arm may extend upwardly at an inclination from the adjustable connection to a point directly above the center of gravity of the overall spinner for attachment to a suspending line at that point in a manner assuring proper balancing of the spinner in a horizontal active condition. The arm may be adjustable to slightly different inclinations for precisely locating the point of connection to the suspending line directly above the center of gravity of the tool.

BRIEF DESCRIPTION OF THE DRAWINGS

The above and other features and objects of the invention will be better understood from the following detailed description of the typical embodiment illustrated in the accompanying drawings in which.

DESCRIPTION OF THE PREFERRED EMBODIMENT

Figure 1:
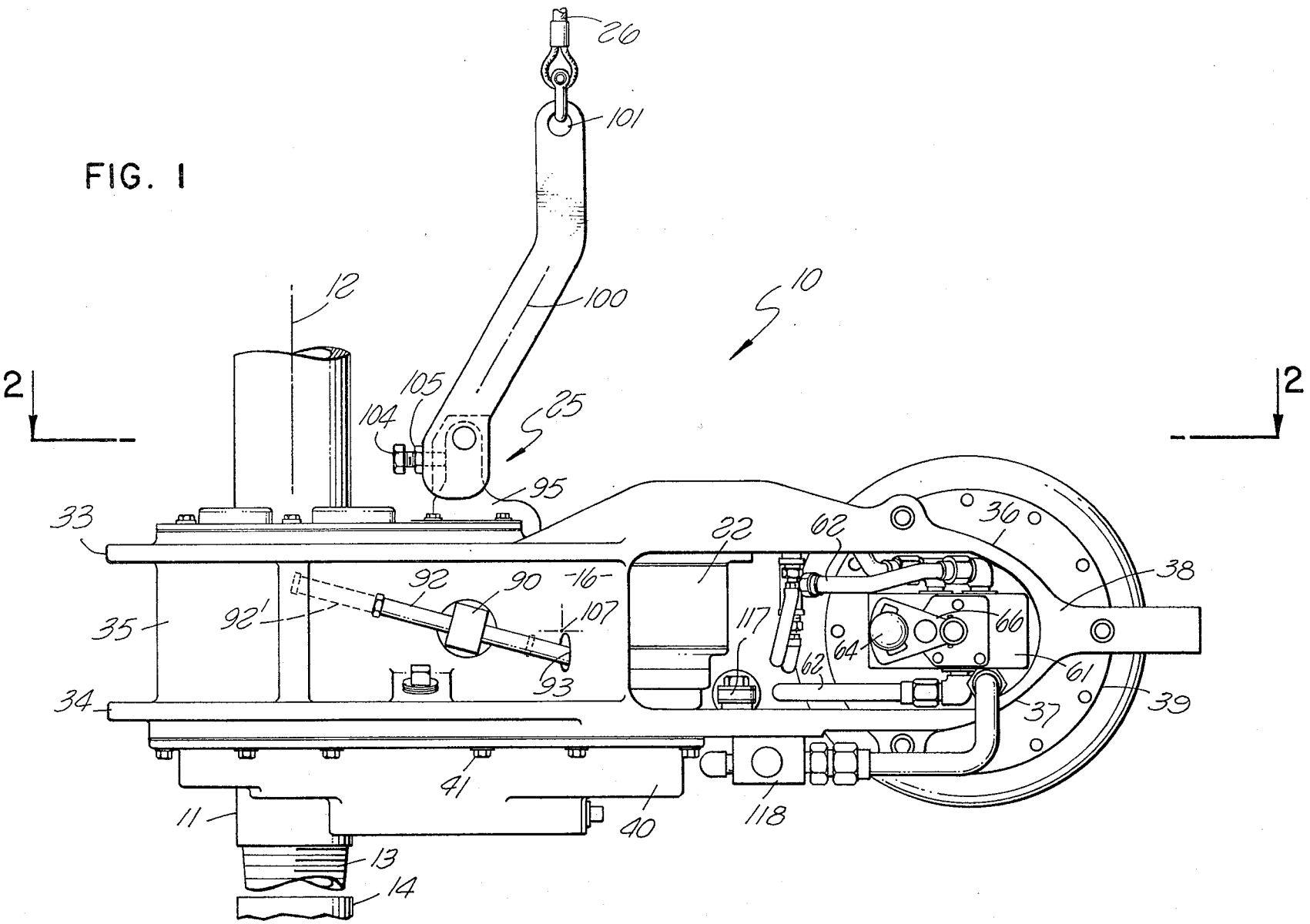
FIG. 1 is a side elevational view of a well pipe spinner constructed in accordance with the invention.
Figure 2:
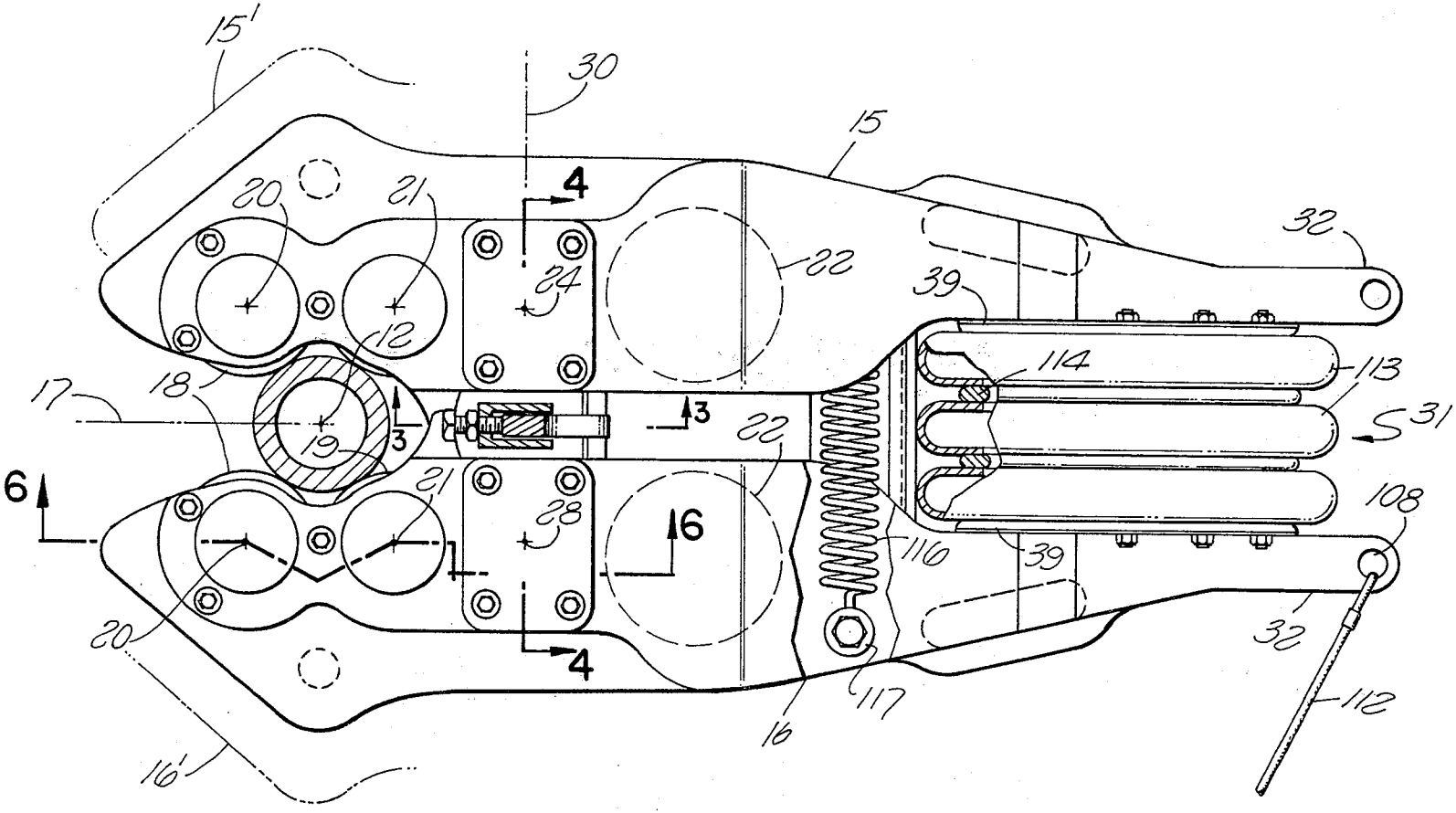
FIG. 2 is primarily a plan view of the FIG. 1 tool, taken on line 2—2 of FIG. 1.

The well pipe spinner 10 illustrated in the drawings is adapted to be moved into the FIGS. 1 and 2 position of engagement with a vertical well pipe section 11 and acts to spin that pipe section rapidly about the vertical axis 12 of the well to either connect the lower threaded end 13 of section 11 to the next lower section 14 of a drill string or other string of well pipe, or to spin section 11 out of threaded engagement with section 14. Tool 10 includes two body halves 15 and 16 which may be essentially mirror images of one another with respect to a vertical central plane 17 of the tool extending through axis 12. Each of the body halves 15 and 16 carries two rollers 18 and 19 (FIG. 2), which are driven rotatably relative to the corresponding body section 15 or 16 and about two axes 20 and 21, with two motors 22 being carried by the body sections 15 and 16 respectively and acting to drive the rollers to turn an engaged well pipe.

Body section 15 and its carried rollers and motor are mounted by a pivotal connection 23 for swinging movement about a vertical axis 24 relative to a hanger assembly 25 by which the tool is suspended from a flexible line or other suspending member 26 attached to the rig derrick. A second pivotal connection 27 mounts the second body section 16 for pivotal movement about another vertical axis 28 relative to hanger assembly 25 and relative to section 15. These pivotal connections thus mount the two body sections and carried rollers for swinging movement between open positions represented in broken lines at 15' and 16' in FIG. 2, in which positions the rollers are out of engagement with the well pipe and the tool can be moved into and out of active position about the pipe, and the full line active position of FIG. 2 in which the rollers engage and tightly grip the pipe to turn it rotatively.

To enable adjustment of the tool for engagement with pipes of different sizes, the two pivotal connections 23 and 27 are joined together by an adjustable connection 29 enabling the pivotal connections and their axes 24 and 28 to be shifted toward and away from one another along a transverse horizontal axis 30 which is perpendicular to plane 17. In any of the various settings of pivotal connections 23 and 27 relative to one another, the body sections can be pivoted about their individual axes 24 and 28 in directions to bring their left ends as viewed in FIG. 2 toward one another and against the pipe, with this gripping actuation of the body members and rollers being effected by a fluid pressure operated actuating unit 31 interposed between and acting to forceably spread apart the right end portions 32 of body sections 15 and 16.

Figure 6:
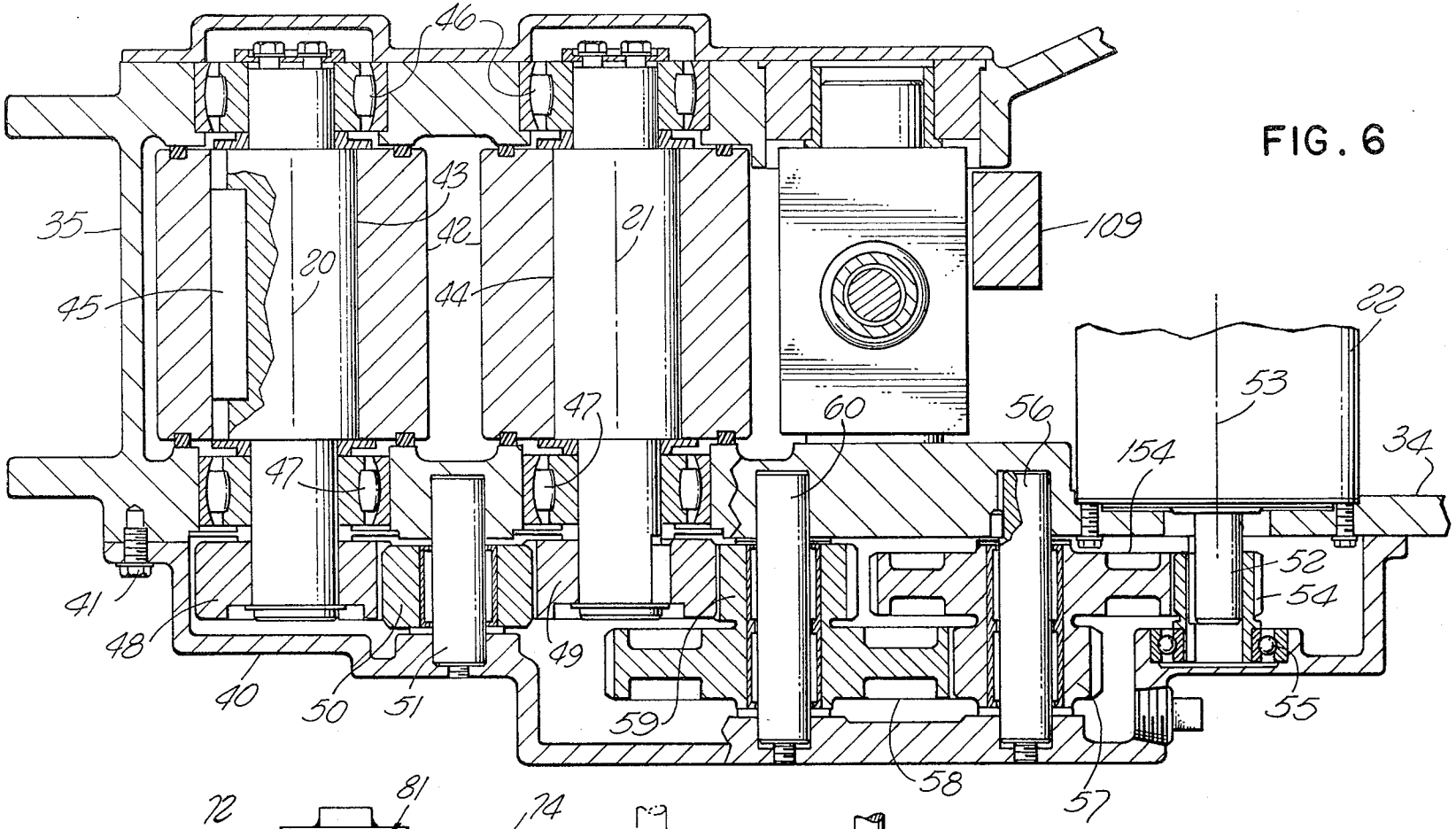
FIG. 6 is an enlarged fragmentary vertical section through one of the roller drive assemblies taken on line 6—6 of FIG. 2.

Each of the body sections 15 and 16 may be formed primarily of rigid metal casting having vertically spaced horizontal and parallel top and bottom walls 33 and 34 (FIG. 4) joined near their left ends as viewed in FIG. 1 by vertical walls 35, and joined at their right ends by portions 36 and 37 which merge together at 38 and carry circular end plates 39 of the fluid pressure actuated assembly 31. A hollow gear housing 40 may be connected to the underside of each of the body sections 15 and 16, as by bolts or other fasteners represented at 41, to contain portions of the gear drive for turning the rollers (FIG. 6).

Pipe engaging rollers 18 and 19 have outer cylindrical surfaces 42 for frictionally engaging and driving the well pipe, and are carried by individual shafts 43 and 44 retained against rotation relative to the rollers by keys 45. The shafts are journalled for rotation relative to body sections 15 and 16 by upper and lower bearings 46 and 47, with gears 48 and 49 being carried by and keyed to the lower ends of the two shafts 43 and 44 of each pair of rollers and engaging an intermediate gear 50 through which gear 49 drives gear 50 and roller 18. Each of the gears 50 may be mounted for rotation about a vertical axis by a shaft 51 connected at its upper end to the corresponding one of the body sections 15 or 16 and at its lower end to the lower housing 40 carried by that body section.

Each of the drive motors 22 is mounted to one of the body sections 15 or 16, and is received between top and bottom walls 33 and 34 of that section. Each motor has a driven shaft 52 (FIG. 6) which projects downwardly beneath bottom wall 34 and is power rotated about a vertical axis 53 to drive a gear 54 journalled by a bearing 55. Gear 54 in turn drives a gear 154 which is carried rotatively about a vertical shaft 56 and has a reduced diameter gear portion 57 engaging a larger diameter gear 58 to turn it and a connected smaller diameter gear 59 about a vertical shaft 60. The gear 59 in turn meshes with and drives the previously mentioned gear 49 to turn the rollers. As will be understood, this entire drive mechanism is duplicated for each of the body halves and carried rollers, with the gear mechanism functioning as a reduction gear assembly acting to turn the rollers at a speed substantially slower than the speed of rotation of the motor. The two rotary motors are preferably fluid driven, either hydraulically or pneumatically, under the control of a manually actuated reversing valve represented at 61 in FIG. 1, with that valve being actuable between an off position in which no fluid is supplied to the motors and they do not turn, a second position in which fluid is supplied to both of the motors to turn them in a first direction for spinning pipe 11 in one direction, and a third position in which fluid is supplied to the motors to turn them in the opposite direction to reverse the direction of drive of the well pipe. Valve 61 is carried by one of the two body sections 15 and 16, and is connected to the two motors by appropriate fluid supply and exhaust lines 62 which include flexible hoses extending to the motor of the other body section to avoid interference by the fluid lines with the previously discussed relative movement of the sections.

Figure 7:
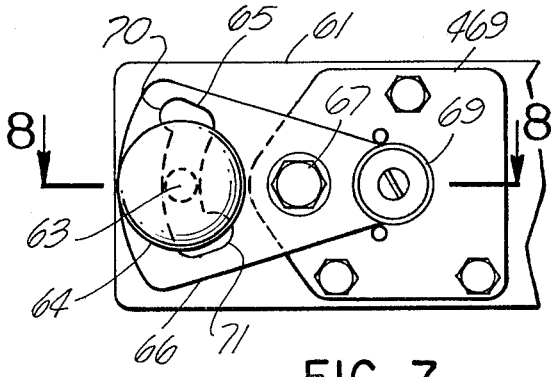
FIG. 7 is an enlarged fragmentary elevational view corresponding to a portion of FIG. 1.
Figure 8:
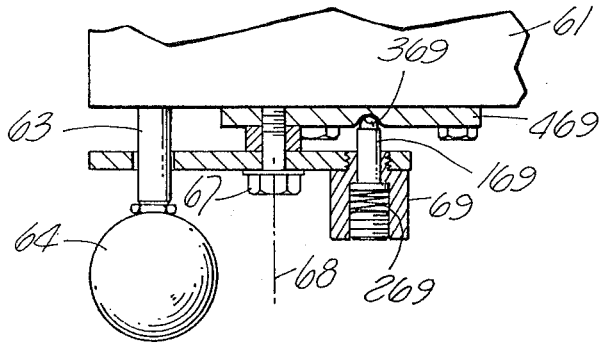
FIG. 8 is a fragmentary horizontal section taken on line 8—8 of FIG. 7.

Valve 61 is illustrated as of a type having an actuating shaft 63 which is movable leftwardly and rightwardly as viewed in FIGS. 1, 7 and 8 by manual movement of a handle knob 64 carried at the end of the shaft. FIGS. 1, 7 and 8 illustrate the shaft in its central position in which all fluid to the motors is turned off, and in which the shaft 63 is retained against either leftward or rightward movement by reception within an arcuate slot 65 formed in a part 66 which is mounted by a connection 67 for pivotal movement about an axis 68 relative to body section 16. A knob 69 is connected to the opposite end of part 66 and acts to pivot it about axis 68 between the illustrated off position and the two on positions. If part 66 is pivoted in a counterclockwise direction as viewed in FIG. 7 far enough to bring a leftwardly extending radial branch 70 of slot 65 into horizontal alignment with shaft 63, this frees the shaft for leftward movement far enough to open the valve in one direction for turning the motors in a corresponding predetermined direction. Similarly, pivotal movement of part 36 about axis 68 to a position in which a rightwardly extending radial branch 71 of arcuate slot 65 is in horizontal alignment with valve shaft 63 enables the shaft to be moved rightwardly to open the reversible valve 61 in an opposite direction for driving the motors in their reversed direction. Thus, the element 66 acts to positively prevent accidental reversal of the direction of rotation of the motor, and to prevent any injuries which might result from such accidental reversal. Element 66 may be releasably retained in each of its three described settings by an appropriate detent mechanism, such as a detent pin 169 (FIG. 8) carried within handle 69 and urged axially by a spring 269 into detenting notches or recesses 369 formed in a plate 469 carried by the body of switch 61.

Figure 4:
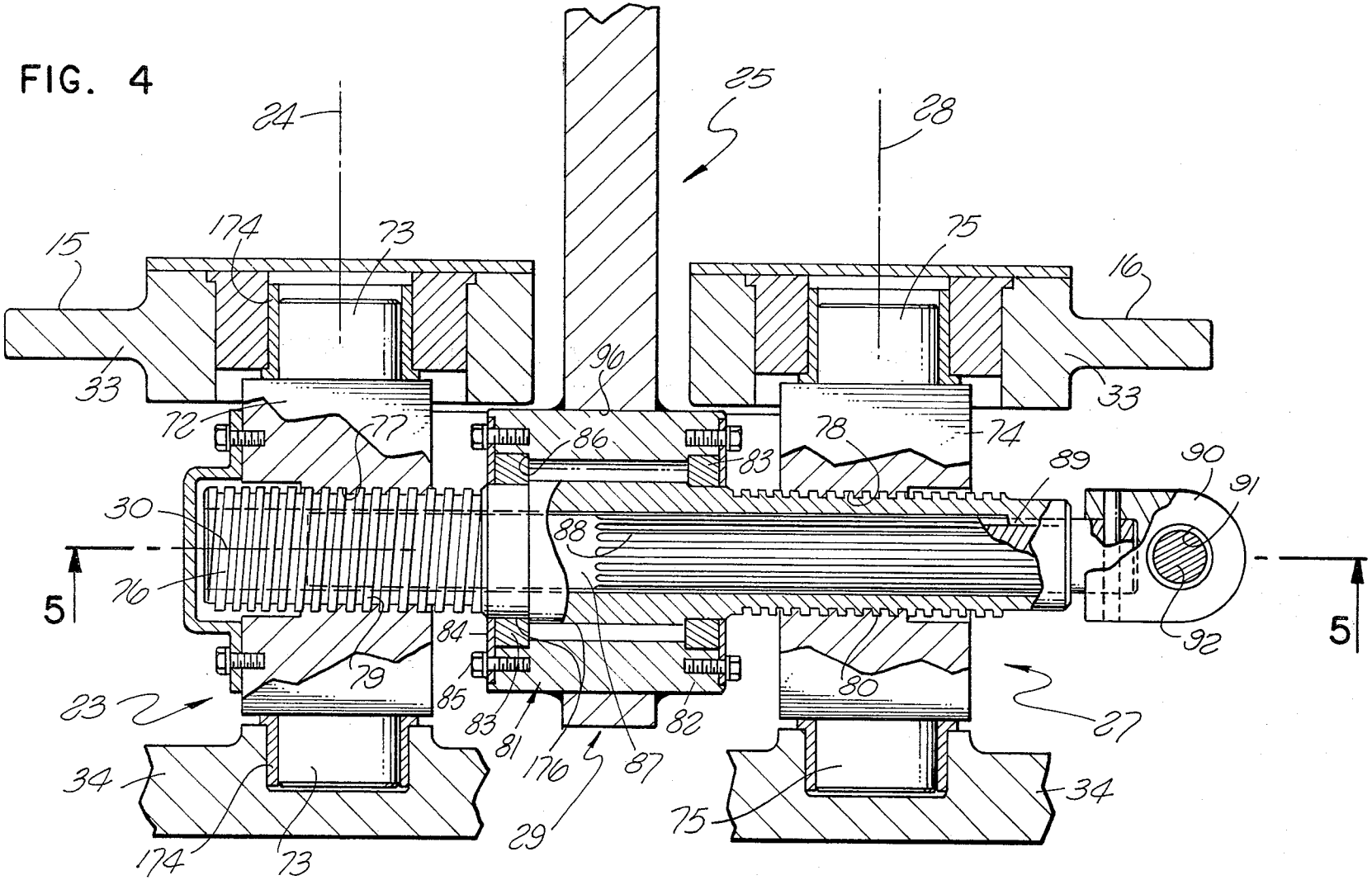
Figure 5:
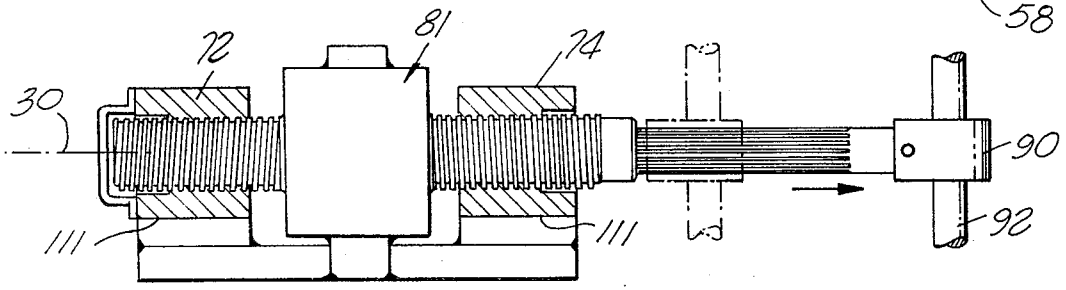
FIG. 5 is a reduced scale horizontal section taken primarily on line 5—5 of FIG. 4.

Referring now to FIGS. 4 and 5, the pivotal connection 23 which mounts body part 15 for pivotal movement about axis 24 may include a block 72 having aligned upper and lower stub shaft portions 73 journalled within bushings 174 carried by body section 15 to mount the body section for the desired pivotal movement about axis 24 relative to block 72. The second pivotal connection 27 similarly includes a block 74 having upper and lower stub shafts 75 journalled in body section 16 to mount that section for pivotal movement relative to block 74.

The adjustable connection 29 which permits relative shifting movement of the two pivotal connections 23 and 24 may include a threaded adjusting shaft 76 extending along and centered about transverse axis 30, and include portions of blocks 72 and 73 containing internal right and left-hand threads 77 and 78 respectively engaging two sets of right and left-hand threads 79 and 80 formed on opposite ends of the shaft. A central unthreaded portion 176 of shaft 76 is mounted by a support bearing 81 for rotary movement in either direction about axis 30, so that rotation of the shaft in one direction acts by virtue of the right and left-hand threads to move blocks 72 and 74 relatively toward one another while rotation of the shaft in the opposite direction moves the blocks away from one another.

The bearing element 81 may include a tubular body 82 (FIG. 4), within opposite ends of which a pair of bushing rings 83 are retained by end plates 84 secured by screws 85, with rings 83 bearing against shoulders 86 formed on part 82 to retain the shaft against axial movement relative to bearing structure 81, while journalling the shaft for the desired rotation about axis 30. The shaft 76 may be tubular, and be adapted to be rotated by an inner shaft element 87 which is slidably movable along axis 30 from the inactive retracted position shown in FIG. 4 and in broken lines in FIG. 5 to the active position shown in full lines in FIG. 5. To enable such relative axial movement of inner shaft element 87, that part may have outer keyways or spline grooves 88 slidably engageable with inwardly projecting splines 89 formed in the inner surface of the end portion of outer tubular shaft 76, to form an effective rotary drive connection between parts 76 and 87 in the different axial settings of the latter while permitting shafting movement of element 87 between its active and retracted positions. At its outer end, part 87 may carry an eye element 90 having an opening 91 within which a rod 92 is received to enable the threaded adjusting shaft 76 to be manually turned by that rod when the shaft is in its outer full line position of FIG. 5. When the shaft is in its inner broken line position of FIG. 5, the eye element 90 and rod 92 are received within the recess formed vertically between the top and bottom walls 33 and 34 of body section 16, to be protected thereby, and rod 92 is movable axially within the opening 91 of eye element 90 between the position of that rod illustrated at 92' in broken lines in FIG. 1 and the full line position in which an end of the rod extends into an opening 93 formed in body section 16 in a relation retaining the adjusting shaft 76 against rotation and in a set position.

Bearing assembly 81 and the supported threaded adjusting screw 76 are connected to and supported by hanger assembly 25. This assembly may include a first hanger part 95 typically containing an opening 96 (FIG. 3) within which part 82 of bearing 81 is received, with the part 82 being rigidly secured to part 95, as by welding. The hanger part 95 has an upwardly projecting portion 97 pivotally connected by a horizontal pin 98 to an upper or second hanger part 99 taking the form of a rigid arm extending upwardly along an inclined axis 100 to an upper connecting portion 199 containing an opening 101 or other means by which part 99 is attached to suspending line 26. Portion 97 of the lower hanger part 95 projects upwardly into a recess 102 formed in the underside of part 99, with a front wall 103 of the recess carrying an adjustable screw 104 threadedly connected into that front wall and lockable in any set position by a jam nut 105. This screw engages a front face 106 of portion 97 of part 95 to limit the pivotal movement of part 95 relative to part 99.

The center of gravity of the entire tool is located at the point 107 in FIG. 1, which point is rearwardly of the pivotal and adjustable connections represented in FIGS. 4 and 5 (rightwardly in FIGS. 1 and 2) and is directly beneath the point 101 at which suspending line 26 is connected to the upper end of hanger arm 99. During use of the tool, lines or other elements for retaining the tool against rotation about the well axis may be connected to the outer ends of the body parts at 108 (FIG. 2), and any such elements may alter slightly the location of the overall center of gravity of the tool (including such weight as may be added to the right end of the tool by that line or other element). The adjustment afforded by screw 104 and its jam nut 105 enable the position of the upper connecting end portion 101 of arm 99 to be shifted slightly to the right or to the left in order to compensate for any such slight change in position of the center of gravity, and thus assure positioning of the opening 101 directly above the overall center of gravity to hang the tool in a properly balanced position.

Figure 3:
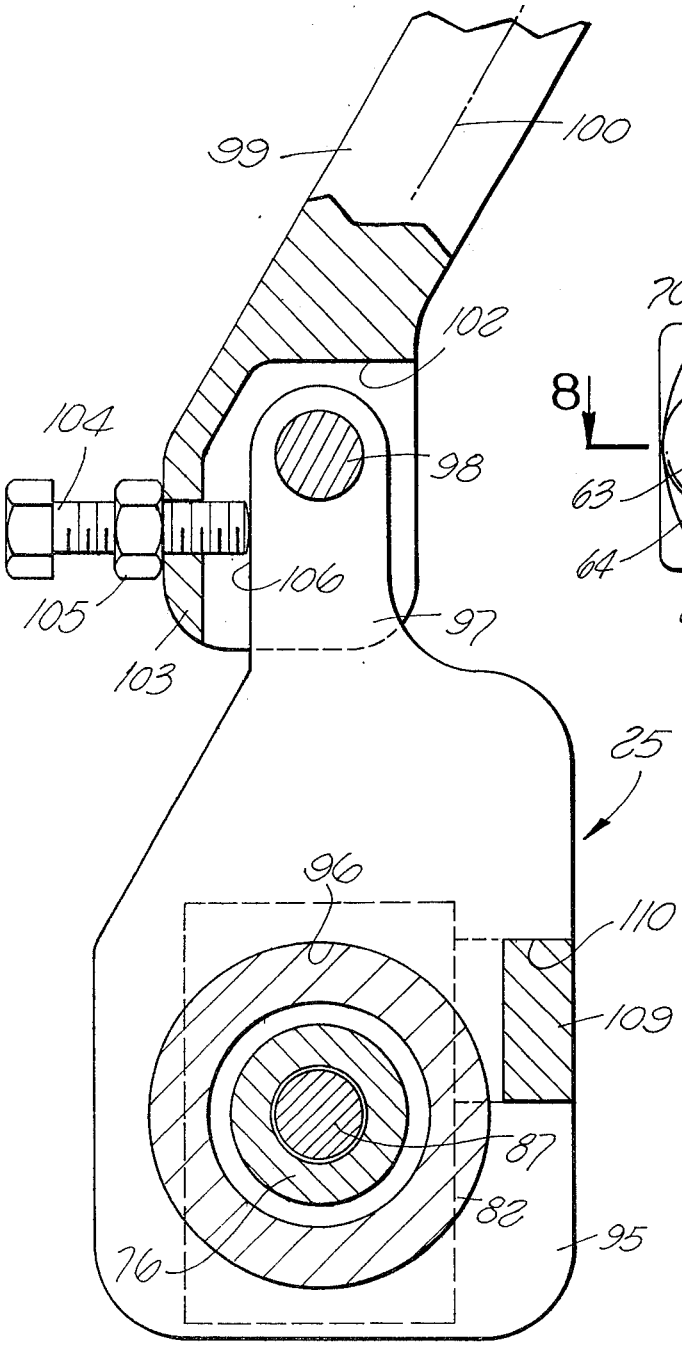
FIGS. 3 and 4 are enlarged fragmentary vertical sections taken on lines 3—3 and 4—4 respectively of FIG. 2.

In order to prevent rotation of the tool body sections and other parts about transverse axis 30 of the adjusting shaft 76 and relative to support bushing 81, hanger part 95 carries a rigid transverse stop member 109, which may extend through an opening 110 in part 95 and be rigidly welded to that part, and which projects laterally in opposite directions as illustrated in FIG. 5 to have portions received behind and in engagement with rear vertical faces 111 of blocks 72 and 74 to prevent clockwise pivotal movement of those blocks and the carried body parts and other portions of the tool relative to member 95 as viewed in FIG. 3. The engagement of the blocks with member 109 is such as to maintain the tool in a directly horizontal position as illustrated.

Actuating unit 31 for pivoting body sections 15 and 16 between their active and released positions preferably takes the form of a bellows assembly interposed between the outer ends of the body sections and urging them relatively apart. The bellows assembly may include several annular bellows elements 113 (preferably three as shown) bonded or otherwise secured annularly in sealed relation to intermediate rings 114 and to the previously mentioned end plates 39 attached to sections 15 and 16. These various parts all form together a single bellows assembly containing an inner chamber for receiving pressurized air or other actuating fluid and adapted to expand along an axis 115 (FIG. 2) when pressurized to force the roller carrying ends of body sections 15 and 16 against the pipe. When the pressure within the bellows is released, the right ends of body parts 15 and 16 as viewed in FIG. 2 are returned toward one another by a coil spring 116, whose ends 117 are connected to parts 15 and 16 respectively and which is at all times under tension to urge the right ends of parts 15 and 16 together. A manually actuated valve 118 controls delivery of pressurized fluid to the bellows and discharge of the pressurized fluid therefrom.

In placing the spinner in use, the tool may first be suspended from line 26 in the manner illustrated in FIG. 1, and be retained against rotation about the well pipe axis by connection of a line 112 to portion 32 of one of the body sections, after which adjusting screw 104 may be adjusted as necessary to maintain the tool in a directly horizontal position, with the screw being locked in its set position by jam nut 105. Valve 118 is actuated to a condition in which it relieves fluid pressure from the interior of bellows structure 31, to enable spring 116 to pull the right end portions of body sections 15 and 16 as seen in FIG. 2 relatively toward one another and thus spread the rollers 18 and 19 apart so that the tool can be moved to a position about the well pipe. Valve 61 may then be actuated to apply fluid pressure to the interior of the bellows assembly 31, and spread the right ends of body sections 15 and 16 apart causing their left ends and rollers 18 and 19 to move toward one another into tight gripping engagement with the well pipe. Element 66 is then moved to a position enabling valve 61 to be actuated by knob 64 in one of its directions to cause rotation of motors 22 in a predetermined direction for spinning the pipe either to connect section 11 to section 14 or unscrew the sections as desired. After the threaded connection has been made or broken as desired, valve 61 is moved back to its off position and the pressure to the bellows may be released to enable the roller carrying ends of the body sections to open under the influence of spring 116 until the next successive spinning operation.

If the device is to be utilized on a different size pipe, the operator moves rod 92 leftwardly as viewed in FIG. 1 and out of the confining opening 93 in body section 16 (broken line position of FIG. 1), and then pulls that rod and the connected shaft 87 axially outwardly to the full line position of FIG. 5, enabling the shaft 87 and surrounding shaft 76 which is keyed or splined thereto to be rotated in a manner actuating blocks 72 and 74 relatively toward or away from one another to bring their axes 24 and 28 into a proper spaced relationship for effectively gripping the changed size of pipe. When the desired setting is reached, rod 92 and shaft 87 are pushed inwardly to the broken line position of FIG. 5, and the rod is moved axially into opening 93 in body section 16 to lock the adjustment in a set condition. The tool may then be utilized in this changed condition for rotating the well pipe in either direction.

It is particularly noted that the unique manner of supporting the adjustable threaded connection from hanger assembly 25 suspends the tool in an effectively balanced horizontal condition in any of the various settings of adjustable connection 29. In each such setting, the two pivotal connections 23 and 27 and their pivotal axes are offset equal distances in opposite directions from hanger parts 95 and 99, and by virtue of the symmetry of the entire tool with respect to the hanger assembly regardless of the adjusted condition of connection 29 the tool is balanced with respect to the hanger and is suspended from the point 101 directly above the center of gravity of the tool, with the horizontal condition of the tool being maintained by the engagement of the blocks with member 109.

While a certain specific embodiment of the present invention has been disclosed as typical, the invention is of course not limited to this particular form, but rather is applicable broadly to all such variations as fall within the scope of the appended claims.

I claim:

1. A pipe spinner comprising:

a plurality of rollers engageable with a pipe at different locations about its periphery and adapted to grip and spin the pipe;

two body members having portions receivable at different sides of said pipe and each carrying at least one of said rollers;

two pivotal connections mounting said body members for swinging movement about two spaced axes respectively between a closed position in which the rollers grip and drive a pipe and an open position releasing the pipe;

an adjustable connection attaching said two pivotal connections together for relative lateral adjusting movement in a relation shifting said pivotal axes toward and away from one another to grip and drive different sizes of pipe;

powered means for swinging said body members about said axes and between open and closed positions in differently spaced conditions of said axes; and support means attached to said adjustable connection and adapted for connection to a suspending element in a manner suspending said adjustable connection from said element and suspending said pivotal connections and said body members and said rollers from said element through said adjustable connection.

2. A pipe spinner as recited in claim 1, in which said support means is adapted to suspend said adjustable connection and the remainder of said spinner from a point essentially directly above the center of gravity of the spinner.

3. A pipe spinner as recited in claim 1, in which said support means includes an arm having a lower end attached to said adjustable connection and an upper end connectable to said suspending element at a location offset horizontally with respect to the point of attachment of said lower end to the adjustable connection.

4. A pipe spinner as recited in claim 1, in which said support means include a hanger arm extending upwardly from said adjustable connection to a point of attachment of said arm with said suspending element, and means for adjusting said arm relative to said adjustable connection in a relation locating said point of attachment of the arm to said element directly above the center of gravity of the spinner.

5. A pipe spinner as recited in claim 1, in which said support means include a first hanger part attached to said adjustable connection, a second hanger part connected pivotally at a first location to said first hanger part and projecting upwardly therefrom and attachable at an upper connecting location offset horizontally with respect to said first location and essentially directly above the center of gravity of the spinner to said suspending element, and an adjusting screw carried by one of said hanger parts and adapted to adjustably bear against the other of said hanger parts in a relation limiting the relative pivotal movement of said parts to properly position said upper connecting location above and in alignment with said center of gravity.

6. A pipe spinner as recited in claim 1, in which said adjustable connection includes two threaded elements threadedly engaging one another and threadedly adjustable to shift one of said axes toward or away from the other.

7. A pipe spinner as recited in claim 6, said support means including a hanger member connected to one of said threaded elements in a relation to support it and to support other parts of the spinner through said one threaded element.

8. A pipe spinner as recited in claim 1, in which said adjustable connection includes first and second threaded elements attached to said two pivotal connections respectively and having right-hand and left-hand threads respectively, and a third threaded element having right-hand and left-hand threads engaging said first and second threaded elements in a relation moving said first and second elements and the axes of said pivotal connections toward and away from one another in response to rotation of said third threaded element in opposite directions, said support means being connected to said third threaded element in supporting relation for supporting the pipe spinner through said third threaded element.

9. A pipe spinner as recited in claim 1, in which said adjustable connection includes a part suspended by said support means for relative rotation about a third axis, and stop means for limiting pivotal movement of said body members about said third axis relative to said support means.

10. A pipe spinner as recited in claim 1, in which said adjustable connection includes an adjusting part suspended by said support means and which is operable by rotation about a generally horizontal third axis relative to the support means to shift said pivotal connections toward and away from one another, and stop means limiting pivotal movement of said body members about said third axis relative to said support means.

11. The combination comprising a pipe spinner as recited in claim 1, and a flexible suspending line functioning as said suspending element and connected to said support means in said suspending relation.

12. A pipe spinner comprising:

a plurality of rollers engageable with a pipe at different locations about its periphery and adapted to grip and spin the pipe;

two body members having portions receivable at different sides of said pipe and each carrying at least one of said rollers;

two pivotal connections mounting said body members for swinging movement about two spaced axes respectively between a closed position in which the rollers grip and drive a pipe and an open position releasing the pipe;

two nut elements attached to said two pivotal connections respectively and having right-hand and left-hand threads respectively;

a threaded shaft structure having right-hand and left-hand threads engaging said two nut elements respectively in a relation moving said nut elements and the axes of said two pivotal connections toward and away from one another in response to rotation of said shaft structure in opposite directions;

powered means for swinging said body members about said two axes and between open and closed positions in differently spaced conditions of said axes;

motor means operable to drive at least one of said rollers rotatively and thereby turn the pipe in differently spaced conditions of said axes; and a support structure connected to and rotatively supporting said shaft structure and adapted for connection to a suspending element in a manner suspending said shaft structure and said nut elements, pivotal connections, body members and rollers from said suspending element through said support structure.

13. A pipe spinner as recited in claim 12, in which said support structure includes a member disposed about said shaft structure between said nut elements and within which the shaft structure is journalled for rotary movement to adjust the two nut elements and said axes toward and away from one another.

14. A pipe spinner as recited in claim 12, in which said support structure includes a hanger arm extending upwardly from said shaft structure and having an upper connecting portion attachable to said suspending element essentially directly above the center of gravity of said spinner.

15. A pipe spinner as recited in claim 14, including means for adjusting said hanger arm pivotally relative to said shaft structure.

16. A pipe spinner as recited in claim 12, in which said support structure includes a first hanger part supporting said shaft structure at a location between said two nut elements and by which said shaft structure is journalled for rotation about the longitudinal axis thereof to shift the nut elements and axes toward and away from one another, a second hanger part pivotally connected at a lower end thereof to said first hanger part and projecting upwardly therefrom to an upper attaching location essentially above the center of gravity of the pipe spinner and at which said arm is connectible to said suspending element, and a threaded adjusting member carried by one of said hanger parts and adjustable relative thereto and acting against the other hanger part in a relation adjusting the relative pivotal positions of said two hanger parts.

17. A pipe spinner as recited in claim 16, including means for manually turning said shaft structure to relatively adjust said nut elements.

18. A pipe spinner as recited in claim 17, including stop shoulders associated with said first hanger part and said nut elements acting to limit pivotal movement of said nut elements in a predetermined direction relative to said first hanger part and about the axis of said shaft structure to maintain a predetermined orientation of said body members relative to the hanger structure.

19. A pipe spinner as recited in claim 12, including stop means for limiting pivotal movement of said nut elements and body members relative to said support structure about the axis of said shaft structure.

* * * * *